US006178981B1

(12) United States Patent
Wales

(10) Patent No.: US 6,178,981 B1
(45) Date of Patent: Jan. 30, 2001

(54) UNIVERSAL-FIT REPLACEMENT FLANGE AND HANDLE SET

(75) Inventor: Michael Wales, Riverside, CT (US)

(73) Assignee: Resources Conservations, Inc., Stamford, CT (US)

( * ) Notice: Under 35 U.S.C. 154(b), the term of this patent shall be extended for 0 days.

(21) Appl. No.: 09/505,923

(22) Filed: Feb. 17, 2000

Related U.S. Application Data

(60) Provisional application No. 60/163,730, filed on Nov. 5, 1999.

(51) Int. Cl.[7] ..... F16L 5/00

(52) U.S. Cl. ..... 137/15.18; 137/315.12; 137/359; 137/360; 251/293

(58) Field of Search ..... 251/293; 137/359, 137/15.18, 315.01, 360, 315.17, 315.27, 315.36, 15.08, 315.12

(56) References Cited

U.S. PATENT DOCUMENTS

| | | | | |
|---|---|---|---|---|
| 1,543,511 | * | 6/1925 | Niedecken | 137/359 |
| 3,582,116 | | 6/1971 | Young . | |
| 3,669,141 | * | 6/1972 | Schmitt | 137/359 |
| 3,807,453 | * | 4/1974 | Dom et al. | 137/359 X |
| 4,616,673 | | 10/1986 | Bondar . | |
| 4,662,389 | * | 5/1987 | Igbal | 137/359 |
| 4,739,788 | | 4/1988 | Reback . | |
| 4,794,945 | | 1/1989 | Reback . | |
| 4,842,009 | | 6/1989 | Reback . | |
| 4,989,633 | * | 2/1991 | Humpert et al. | 137/360 |
| 5,025,826 | | 6/1991 | Schoepe et al. . | |
| 5,046,521 | * | 9/1991 | Jensen | 137/360 |
| 5,135,022 | * | 8/1992 | Kovey et al. | 137/360 |
| 5,183,069 | * | 2/1993 | Berg et al. | 137/15.18 |
| 5,388,287 | * | 2/1995 | Tischler et al. | 137/359 |

* cited by examiner

*Primary Examiner*—A. Michael Chambers
(74) *Attorney, Agent, or Firm*—St. Onge Steward Johnston & Reens LLC

(57) ABSTRACT

A universal-fit replacement flange and handle set includes a template formed with an easily torn apart material and having a pair of lugs which have free ends with pre-punched holes spaced at a distance from one another. The set further includes mounting brackets, each having opposite ends formed with openings and pivotally mounted on the lug by its one end to pivot in a position, wherein the other end is attached to a support surface. The set has a flange and handle assembly having a pair of recesses spaced at a distance equal to the distance between the pre-punched holes. The recesses are aligned with the pre-punched holes and are traversed by fasteners attaching the flange and handle assembly to the brackets upon removing the template. The set further includes an adapter enabling adjustment of a handle of the flange and handle assembly with respect to the support surface.

22 Claims, 3 Drawing Sheets

UNIVERSAL-FIT REPLACEMENT FLANGE AND HANDLE SET

PRIOR APPLICATION

This application is a continuation in part application of a provisional application No. 60/163,730 filed on Nov. 5, 1999 and fully incorporated herein.

FIELD OF THE INVENTION

This invention is related to a flange and handle replacement set for replacing existing plumbing installations. Particularly, the invention relates to a flange and handle set capable of being mounted to a variety of previously installed handle valves.

BACKGROUND OF THE INVENTION

One of the problems most frequently encountered by a resident of any type of urban or suburban dwelling is a defective plumbing fixture. Particularly, faucets, defective shower or sink handles and the like seem to be a major problem. One of the reasons explaining it is that some of these plumbing appliances have been in use for a long time and have developed structural defects, such as damaged stems, which necessitate replacement thereof. Still another reason is that the originally installed plumbing fixtures may have lost their initial esthetic appeal and need to be replaced by new fixtures having a modern design.

However, a seemingly easy task of replacement these fixtures can easily turn into a major and expensive project. Mechanically inclined amateurs can encounter quite a few unforeseen obstacles. For example, it is not unusual that the local plumbing store does not stock the particular style of valve stem. This is particular true for old plumbing wherein the manufacturer may have discontinued production or totally changed its design. New fixtures recommended to a buyer may radically differ from the original ones requiring special tools and an expertise of a professional plumber. As is well known, a service of a professional plumber is quite expensive and sometimes can take a few days to fix a persisting problem.

Quite often a resident, realizing that replacement of these parts, for example a shower handle, really is not such big a job, decides that he or she is able to do it on her own and, as a consequence, encounters a problem of fitting new parts to old valve installations. For example, mounting a new handle assembly to old shower heads or tub faucets can become an insurmountable task because untrained residents simply cannot attach new details to old mounts. Even if the mounting stage is successfully completed, adjusting a new handle to operate an old valve stem may be technically impossible because the length of the valve and the overall wall thickness have not been designed to fit modern designs. The reason why the latter situation frequently occurs is because there have been established no generally accepted set of standards in the plumbing industry for setting the length or configuration of valve stems, configuration of handles, etc.

Numerous efforts have been made to solve these problems in the past. Primarily, these efforts have been directed at providing a replacement handle set with a group of small adapters or spuds having a variety of cross sections to fit differently sized and shaped valve stems. An exterior of these spuds is uniform to fit the handle cavity, thereby providing a reliable connection between the handle and the valve stem. U.S. Pat. No. 4,482,009 is an illustrative example of such approach. Typically, a number of spuds is substantial enough to fit a new handle to numerous configurations of the previously installed valve stems, thereby increasing the cost of the set.

U.S. Pat. No. 5,025,826 discloses a single adapter including a pair of jaws that are displaceable relative to one another to fit differently sized and shaped valve stems. While this system is relatively cost efficient, a structure of the adapter is not comparatively simple and may not be entirely reliable necessitating frequent adjustments, such as tightening a screw which displaces the jaws.

What is needed, therefore, is a handle replacement set that may include one or more valve stem adapters that are easily adjustable to allow a handle to fit differently sized and shaped valve stems. A handle replacement set that is easily attachable to the previously installed mounts is also desirable, as well as a handle replacement set having a simple structure that, at the same time, has an esthetically appealing design.

SUMMARY OF THE INVENTION

A flange and handle set, in accordance with the invention, including mounting brackets that are controllably displaceable to fit different configurations of the previously installed mounting assemblies and an adjustable stem adapter for connecting a handle assembly with an old valve stem achieves this.

According to one aspect of the invention, the flange and handle set has a template that allows an installer to easily attach a mounting flange, also referred to as an escutcheon, to the old mounts formed with eyelets and attached to a support surface. Particularly, the template, which is temporarily mounted to the support surface so as to surround a valve stem projecting from this surface, has a pair of lugs extending towards the valve stem and provided with holes. These holes are spaced from one another at a distance equal to a distance between recesses formed in the escutcheon and receiving mounting screws which attach the flange and handle replacement set to the support surface. The template receives a pair of mounting brackets pivotally mounted by one of their ends to the holes of the template to pivot in a position, wherein opposite ends of the brackets are aligned with eyelets. Having attached the opposite ends of the brackets to the eyelets, fasteners connecting one ends of the brackets to the template are removed, so as a distance between these one ends of the mounting brackets is equal to the distance between the recesses of the escutcheon.

In accordance with another aspect of the invention, the flange and handle replacement set includes an adapter having opposite ends thereof attached to a valve stem and to a formation provided on the underside of a handle. The adapter has a pair of handle extensions which are displaceable along the opposite ends of the adapter to accommodate a variable distance between the handle and different types of the old valve stems.

According to still another aspect of the invention, the flange and handle replacement set may include a variety of adapters having different shapes and dimensions to allow the handle to be reliably attached to the stem valve.

It is therefore an object of the invention to provide a flange and handle replacement set that can be easily attached to the existing mounts attached to a support surface.

Still another object of the invention is to provide a flange and handle replacement set having a mount assembly allowing an installer to easily attach an escutcheon to mounting brackets whose free ends are spaced at a distance equal to a distance between screw openings formed on the escutcheon.

Yet another object of the invention is to provide a flange and handle replacement set having a controllably adjustable adapter which connects a new handle with differently shaped and sized old valve stems.

Still another object of the invention is to provide a flange and handle replacement set having a group of differently sized and shaped adapters capable of fitting a variety of differently shaped existing valve stems.

BRIEF DESCRIPTION OF THE DRAWINGS

The above and other objects, features and advantages of this invention will become more readily apparent from the following detailed description accompanied by the following drawings, in which.

DETAILED DESCRIPTION OF THE DRAWING

Figures 1, 4A, 4B, 5, 12:
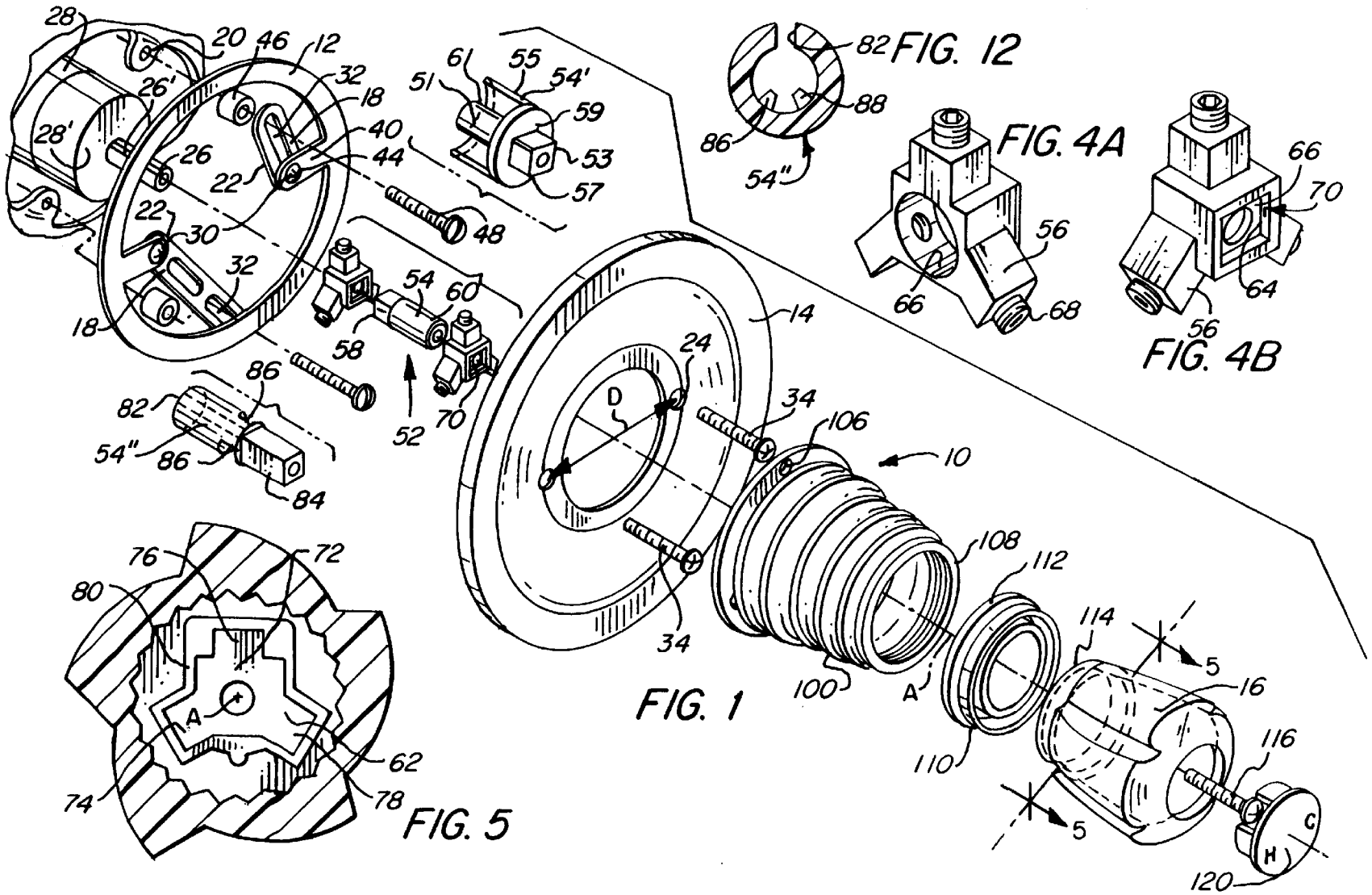
FIG. 1 is an exploded perspective view of a flange and handle replacement set embodying the invention.
FIGS. 4A and 4B are isometric views of handle extenders of the flange and handle replacement set.
FIG. 5 is a cross-sectional view of the underside of a handle of the flange and handle replacement set formed with a formation which is shaped to engage a handle adapter.
FIG. 12 is a cross-sectional view of one of the embodiments of a handle adapter of the flange and handle replacement set in accordance with the invention.

Referring to FIGS. 1–6, a flange and handle replacement set 10 of the invention is shown and generally includes a combination of a template 12, an escutcheon 14 and a handle 16. The flange and handle replacement set, sometimes referred to as a kit, is shaped and sized to enable the handle 16 to be attached to an old valve stem 26 for operating a valve 28.

Particularly, the template 12 made of easily torn material, such as paper, carton or even thin metal, receives a pair of mounting brackets 18 to which the kit 10 is later is attached. According to one aspect of the invention, openings 30 formed in ends 22 of the mounting brackets, which are attached to eyelets 20 by opposite ends, are spaced apart at a distance equal to a distance "D" between recesses 24 of the escutcheon 14 after attachment of the brackets to the eyelets. After the recesses 24 have been aligned with the openings 30, mounting screws 34 traverse the aligned pairs of opening and recesses to attach the escutcheon 14 to the mounting brackets. This is achieved by a structure of the template 12 having two lugs 40 which extend towards one another and have their ends formed with pre-punched holes 42 (FIG. 6) spaced from one another at a distance equal to the distance "D" between recesses 24 of the escutcheon 14.

Figure 3:
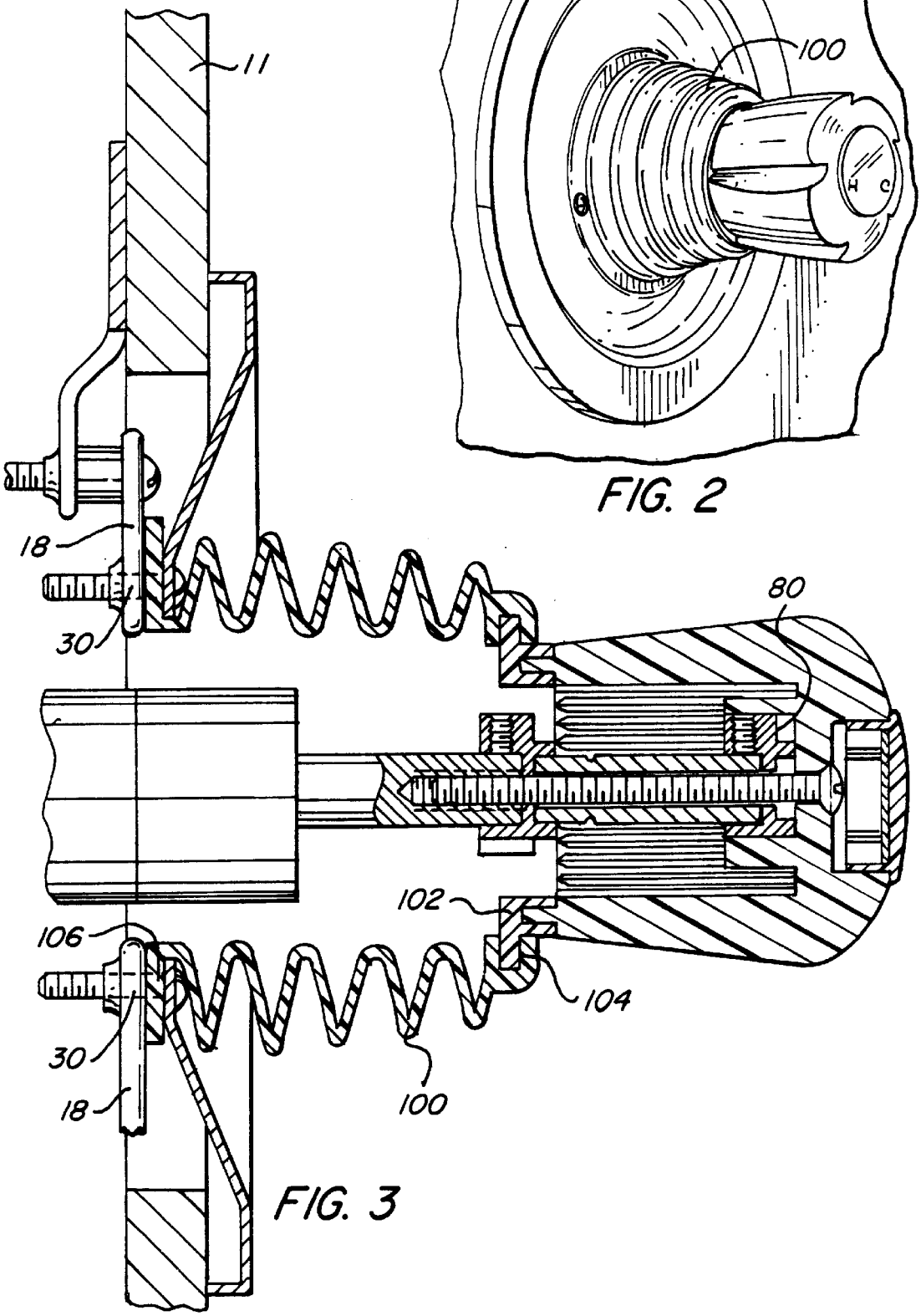
FIG. 3 is a sectional view taken along a longitudinal axis of the flange and handle replacement set which is mounted to a supporting surface.
Figure 6:
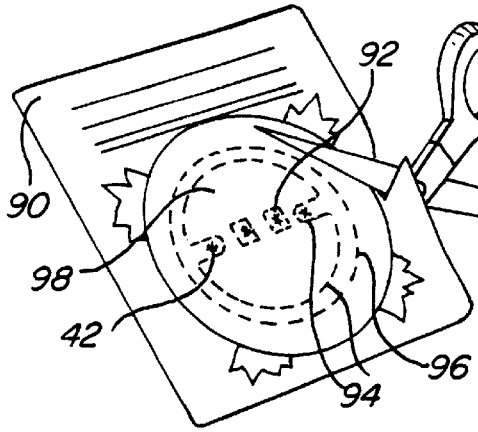
FIG. 6 shown a template of a handle of the flange of the flange and handle replacement set.

Specifically, each mounting bracket 18 has a mounting slot 32 formed on its other end and shaped to be easily aligned with eyelets 20 which has been originally installed in a support surface 11 (FIG. 3). To connect the mounting slots 32 to the eyelets 20, the template is attached to the support surface so it can preferably be coaxial with the valve stem 26. Pressing the template against the support surface with one hand easily provides such placement. Preliminary, however, pre-punched holes 42 of the lugs 40 (FIG. 6) are tapped through by fasteners 44, such as screws, pins, bolts and the like, so as to enable each bracket 18 to pivot about this fastener. Having pivoted the bracket 18 to a position, wherein the mounting slot 32 is aligned with the eyelet 20, the template is attached to the support surface by inserting a guide fastener 48 through the slot 32 into the eyelet 20. If the geometry of the support surface 11 does not allow the bracket 18 to be adjacent to the eyelet, the set 10 includes a variety of differently shaped and sized spacers 46 preferably made of plastic and filling the space between the eyelet and the bracket. These fasteners 48 are preferably screws, which threadedly engage the eyelets 20 formed with inner threads. However, it is understood that any fastener allowing reliable attachment of the brackets to the eyelets can be utilized for this operation.

As is shown in the drawings, the mounting slot 32 is elongated so that regardless of a position of the eyelet 20 the installer is always able to pivot the bracket to a position, wherein a region of the slot is aligned with this eyelet. Further, the brackets do not have to be identical. As shown in the drawings, one of the brackets may be longer than the other and may have two mounting holes, whereas the other bracket may have only one mounting slot 32. Alternatively, instead of two or more slots, the bracket may have one continuous slot, one end of which receives a screw, whereas the rest of the slot functions as a mounting one.

Having reliably attached the bracket to the eyelets, the fasteners 44 are removed from the openings 30 which, as is previously pointed out, are spaced from each other at the distance "D" separating the recesses 24 of the escutcheon 14.

The lugs 40 of the template 12 are coplanar so the installer typically mounts the template to the support surface so as to have the lugs extending generally along a horizontal or vertical line. After detaching the template from the support surface by tearing it apart, the escutcheon 14 is pressed against the support surface with the recesses 24 positioned ether horizontally or vertically with respect to each other. The openings 30 are provided with threaded studs 50 (FIG. 8) formed on an inner face of the bracket and threadedly engaged by the mounting screws 34 which traverse the recesses 24 to removably attach the escutcheon to the brackets.

According to another aspect of the invention, the set 10 has a handle adapting assembly 52 including an adapter 54 and two handle extenders 56. The adapter is formed with opposite ends 58 and 60, which are appropriately sized to fit the valve, stem 26 and a formation 62 (FIG. 5) formed on the underside of the handle 16.

Particularly, the end 58 has a polygonal outer surface while the opposite end 60 is cylindrical. Both ends are sized so as to enable these ends to slide into a circular recess 64 and a polygonal recess 66 of the extenders 56, respectively. However, the polygonal recess 64, which in shown to have a square cross-section, is sized so that the end 58 has to be forcibly pushed in the recess in order to fit it.

The other circular end 60 freely slides along the circular recess of the other extender 56 and is pressed upon by a set screw or set screws traversing one or more studs 68 which are formed on an exterior of each extender. Each of the studs is formed with a threaded interior communicating with an interior of the circular recess. It is understood that nothing prevents the adapter from having opposite ends 60 and 58 to be shaped differently from the shapes described above. Analogously, the recess 66 and 64 also can be shaped and sized differently as long as the adapter 54 can be reliably attached to the extenders 56.

The circular recess 66 is relatively deep while the polygonal recess 64 is relatively shallow. After receiving the rectangular end 58 of the adapter 54, this extender is pushed over the valve stem 26. Analogously to circular end 60 of the adapter, the valve stem can relatively freely slide along the recess 66. Thus, adjusting the position of both extenders 56 on the valve stem and on the end 60 of the adapter, the installer can adjust a desirable length of the entire adapting assembly 52. The length adjustment is obviously completed when outer surfaces of the extenders 56 urge against a front surface 28' of the valve 28 and the underside of the handle 16, respectively. Having reached this desirable length, the installer tightens the set screws against the valve stem and the end 60 of the adapter.

The rational behind adjusting the overall length of the adapting assembly is to provide engagement between the handle 16 and the valve stem 26 so as to transmit a torque generated by user who rotates or pivots the handle to the valve stem which opens and closes the valve 28.

To realize such engagement, the set 10, in accordance with another aspect of the invention, has the underside of the handle 16 formed with the formation 62. The formation is sized to surround and to axially overlap an end 70 of the extender 56 facing the handle and is shaped to engage this end 70 so as to enable synchronous displacement of the valve stem 26 and the handle 16.

The formation 62, as shown in FIG. 5, has a cross section 72 including three parts 74, 76 and 78 which extend from one another at a 120° angle and conform to respective surfaces of the extender 56 so as to rotationally engage the latter without a possibility of slippage. Clearly, the most reliable cross section of each of the matching parts is polygonal. However, it is foreseeable to apply different oval or even round shapes to an outer contour of the end 70 of the extender 56 and to the inner surface of the formation 62. Having different radii the engaging surfaces will be prevented from the slippage during displacement of the handle 16 around a center axis A.

Within this aspect of the invention, the set 10 may be provided with a group of adapters 54' and 54" instead of the adapting assembly 52. In order to easily adjust the handle 16 to a valve stem, the adapter 54' has a sleeve 53 formed with opposite cylindrical 51 and square 57 ends. The cylindrical end 51 receives the valve stem 26, whereas the square end 57 is inserted in the formation 62 of the handle. Analogously to the previously described embodiment, the cross-section 72 of the formation 62 is shaped and sized to allow slipless engagement between the handle and the sleeve to enable their synchronous displacement about the axis A. To transmit a torque to the stem valve 26, the cylindrical end 51 of the adapter 54' has an inner periphery differing from a round shape. Thus, this inner periphery may have an oval, polygonal or any other cross-section enabling rotational engagement between the adapter 54' and the valve stem 26. A skirt 55 partly surrounding the sleeve 53 has a radius which is slightly less than a radius of the handle's interior, and is formed with an annular end 59 pressing upon an inner edge 80 (FIGS. 3 and 5) of the formation 62. The opposite end 61 of the skirt is shaped and sized to urge against the front surface 28' of the valve 28. While this embodiment of the adapter is esthetically most pleasing because of its design and because it is made of transparent plastic, it is clear that this adapter is limited to a particular distance between the handle and the valve.

Still another embodiment of the adapter is shown at 54" and has a generally cylindrical end 82 receiving the valve stem and an opposite square shaped end 84 which is sized to fit the formation 62 of the handle 16. An inner periphery of the cylindrical end 82 shaped to rotationally engage the valve stem has a pair of lugs 86 extending toward the axis A upon its installation and forming a flat surface that provides slipless engagement between its inner periphery and the disk-shaped valve stem 26. Several designs of the valve stem are known to have a rib 26' which is formed on an outer periphery of the valve stem. As shown in FIG. 12, in order to accommodate this rib, the adapter 54" has an elongated recess 88 shaped and sized to receive this rib, thereby enhancing rotational engagement between the adapter and the valve stem.

Referring to FIGS. 6–11, a method for mounting the brackets 18 to the previously installed old eyelets 20 is shown. First, the installer cuts out the template 12 from a piece of carton 90 which is enclosed in a package and carries indicia including a logo on one of its sides and instructions on the other side. The template may be perforated at 94 and 96 to facilitate a cutting step.

Figure 7:
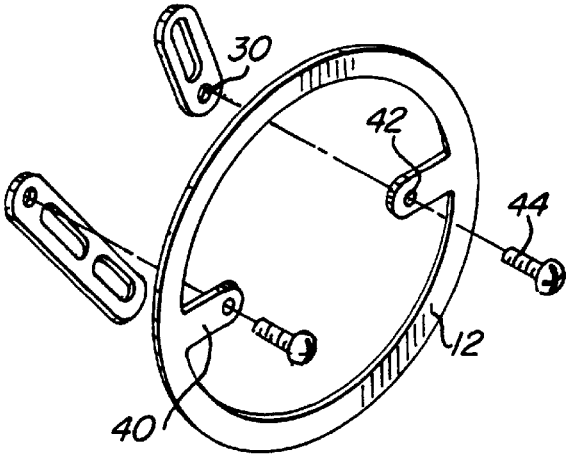
Figure 8:
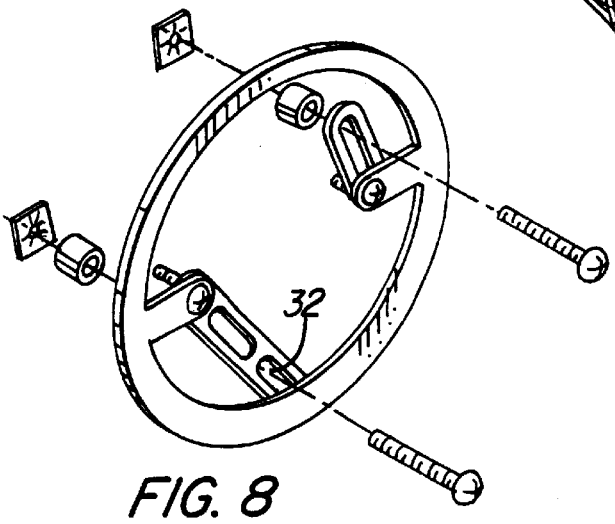
Figure 11:
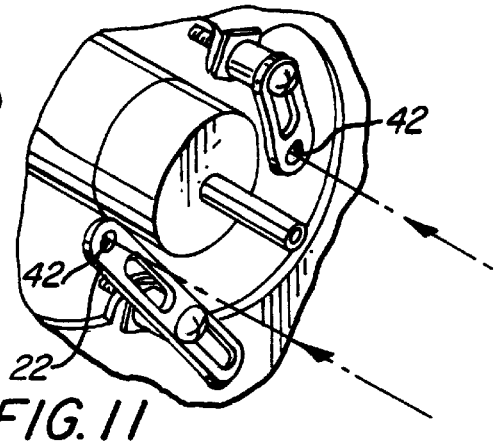

After cutting out an inner region 98 and two paper washers 92, the brackets 18 are attached to an inner side of the template by means of fasteners 44 traversing the pre-punched holes 42 and the openings 30 of the brackets. Preferably, fasteners are screws, as shown in FIGS. 7 and 8.

Figure 9:
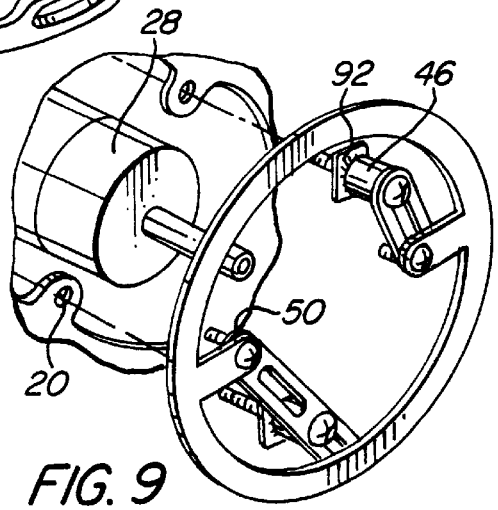
FIGS. 8–11 illustrate a process of installation of mounting brackets of the flange and handle replacement set.
Figure 10:
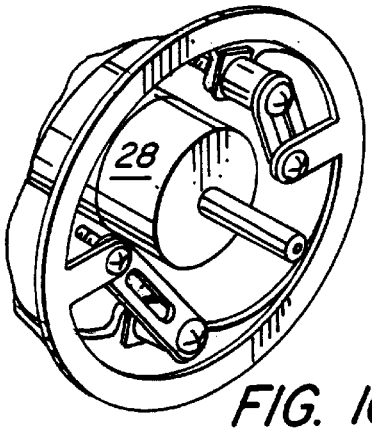

Having attached the brackets to the template, the installer can easily pivot them so as to align the mounting slots 32 of the brackets with the eyelets 20. Spacers 46 mounted on screws 48 by means of paper washers 92 are used to level the brackets if necessary, as shown in FIGS. 9 and 10.

Having mounted the brackets 18 to the old valve, the installer removes the template and the fasteners 44, thereby leaving the ends 38 formed with the holes 42 exactly at the distance corresponding the distance D between the recesses 24 of the escutcheon 14, as shown in FIG. 1.

Figure 2:
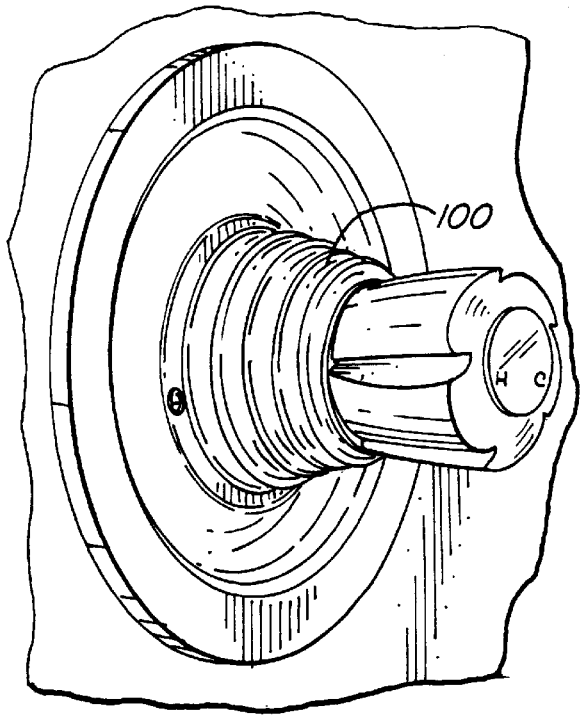
FIG. 2 is an isometric view of the flange and handle replacement set of FIG. 1 shown in an assembled state.

Referring to FIGS. 1–3, in order to complete the assembly, the installer mounts a boot 100 to the escutcheon 14 so as to have its inner edge 102 (FIG. 3) tightly embedded in a groove 104 of the boot. Depending on a particular type of the adapters 54, 54' and 54" the boot can be easily shortened from protruding out of the escutcheon by simply axially pushing it through the inner edge 102. An inner end of the boot is formed with openings 106 aligned with the recesses 24 and openings 30 in a mounting state of the assembly. Preferably, the boot is made of flexible material, such as rubber, plastic and the like. After the boot is attached to the escutcheon, the latter is attached to the brackets by two screws 34 that easily find their way through the openings 30 of the brackets that are aligned with the escutcheon's recesses 24.

After the adapter assembly has been assembled, one of the extenders 56 slides along the valve stem 35 until it urges against the front surface 28' of the valve 28, while the other extender is received by the formation 62 of the handle. To improve contact between an outer end 108 of the boot 100 with the handle, a handle transition piece 110 is mounted to an inner flange 114 of the handle. An outer end 112 of the transition piece 110 has a diameter greater than a diameter of the inner flange 114 and is sized to peripherally contact the outer end 108 of the boot. A handle screw 116 axially extending through the handle, the boot and through the adapting assembly is screwed in the valve stem. To complete the assembly, the installer snaps a position index 120 having "H" and "C" letters on its outer surface in the handle.

Various modifications and changes may be made with regard to the foregoing detailed description without departing from the scope of the invention recited by the following claims.

What is claimed is:

1. A method of mounting a flange and handle assembly of a plumbing fixture on a support surface comprising the steps of:

removably attaching a pair of mounting brackets on a disposable template so as to have one ends of the brackets spaced at a first distance and other ends of the brackets spaced at another distance different from the first one;

attaching the other ends of the brackets to a pair of eyelets;

removing the template from the one ends of the bracket;

providing a handle assembly with a pair of recesses spaced apart at the first distance; and extending a pair of fasteners through the recesses and the one ends of the brackets respectively upon their alignment thereby, attaching the handle assembly to the mounting brackets.

2. A flange and handle replacement set for a plumbing fixture attached to a support surface which has two eyelets spaced at a first distance comprising:

a handle assembly including a mounting flange having a pair of recesses spaced apart at a distance different from the first distance between the eyelets;

a disposable template having a pair of lugs extending toward one another and having distant ends each of which provided with a hole, the holes being spaced apart at the same distance as the distance between the recesses and being aligned therewith; and a pair of fasteners traversing each pair of the recesses and holes.

3. The flange and handle replacement set defined in claim 2 wherein the disposable template is made of an easily torn material selected from the group consisting of paper, carton and the like.

4. The flange and handle replacement set defined in claim 2 wherein the hole formed in each lug is a pre-punched hole.

5. The flange and handle replacement set defined in claim 2 further comprising two brackets, each having an elongated slot, each bracket being pivotally mounted to the distant end of the lug to pivot in a position, wherein one mounting regions of the elongated slot are aligned with the eyelet, whereas the opposite attaching regions of the slots are aligned with the holes and the recesses.

6. The flange and handle replacement set defined in claim 5 wherein the slot of the bracket has a web between the opposite ends of the slot so as to divide the slot into the elongated attaching region and the mounting region.

7. The flange and handle replacement set defined in claim 1 wherein the handle assembly includes a handle and a mounting flange removably attached to each other, the handle having an underside.

8. The flange and handle replacement set defined in claim 7 wherein the underside is formed with formation, the set further comprising an adapter assembly for adjusting a distance between the handle and the mounting flange upon its attachment to the support surface.

9. The flange and handle assembly defied in claim 8 wherein the adapter assembly includes a body having opposite ends and a pair of extensions each mounted on the respective end of the body.

10. The flange and handle assembly defined in claim 9 wherein the opposite ends of the body have end surfaces formed complimentary to boundary surfaces of openings formed in side surfaces of the extensions and receiving these opposite ends.

11. The flange and handle assembly defined in claim 9 wherein one of the extensions facing the formation of the handle has a surface enabling the formation to rotationally engage the extension so as to transmit a torque generated by the handle to the body of the adapter assembly.

12. The flange and handle assembly defined in claim 11, wherein the one extension and the formation have complimentary engaging surfaces, each surface having a polygonal cross-section.

13. The flange and handle assembly defined in claim 9 wherein the extensions are adjustably displaceable along the body of the adapter assembly.

14. A flange and handle set for a plumbing fixture sized to be attached to a support surface which has two eyelets spaced from one another at a distance, comprising:

a handle assembly having two recesses spaced apart at a distance less than the distance between the eyelets;

a template having a pair of lugs extending toward one another and having holes spaced at the distance between the recesses;

two mounting brackets each having opposite ends, one of the opposite ends being pivotally mounted to the holes of the template so as to be spaced at the distance between the recesses to pivot the brackets in a mounting position wherein the other ends of the brackets are spaced apart at the distance between the eyelets; and two fasteners traversing the one ends of the brackets and the recesses.

15. The flange and handle assembly defined in claim 14 wherein the template is made of easily torn material selected from the group consisting of paper, carton, plastic, and thin metal.

16. The flange and handle assembly defined in claim 15 wherein the handle assembly comprises a mounting flange and a handle, the mounting flange having the recesses and being position so as to have the recesses and the one ends of the brackets aligned.

17. A flange and handle replacement set for attaching a plumbing fixture to a support surface having two eyelets which are spaced at a first distance comprising:

a handle assembly including a mounting flange having a pair of recesses spaced apart at a distance different from the first distance between the eyelets;

a disposable template having a pair of lugs extending toward one another and having ends which face one another and each has a hole, the holes being spaced apart at the same distance as the distance between the recesses; and a pair of fasteners traversing each pair of the recesses and holes to attach the handle assembly to the template;

a stem extending between the handle assembly and the template and having opposite ends; and a pair of extensions displaceably mounted on the opposite ends of the stem respectively, displacement of the extensions being arrested upon reaching a desirable distance between the template and the handle assembly.

18. The flange and handle replacement set defined in claim 17 wherein the handle assembly includes a handle and a mounting flange removably attached to each other, the stem extending through the mounting flange to have one of the extensions to press against an underside of the handle, thereby arresting displacement of the extension.

19. The flange and handle replacement set defined in claim 18 wherein the underside having a formation receiving the one extension and having an inner surface complimentary to an outer surface of the extension to enable the handle to rotatably engage the extension and to transmit a torque to the stem.

20. The flange and handle replacement set defined in claim 18 wherein the one extension has at least one channel, the flange and replacement set having an attaching element extending through the one channel to attach it to the stem.

21. The flange and handle assembly defied in claim 18 wherein the other extension and the opposite end of the stem have complimentary contacting surfaces.

22. The flange and handle assembly defined in claim 18 wherein the mounting flange has a central opening traversed by the stem, the central opening receiving a compressible hollow boot mounted between the template the handle.

* * * * *